US005724057A

United States Patent [19]

Kimura et al.

[11] Patent Number: 5,724,057

[45] Date of Patent: Mar. 3, 1998

[54] METHOD AND APPARATUS FOR DRIVING A LIQUID CRYSTAL DISPLAY

[75] Inventors: Yasuhiro Kimura, Yamato; Satoru Nishi, Zama; Takahiro Onodera, Sagamihara, all of Japan

[73] Assignee: International Business Machines Corporation, Armonk, N.Y.

[21] Appl. No.: 335,005

[22] Filed: Nov. 7, 1994

[30] Foreign Application Priority Data

Nov. 5, 1993 [JP] Japan ..... 5-276424

[51] Int. Cl.[6] ..... G09G 3/36

[52] U.S. Cl. ..... 345/89; 345/96; 345/209

[58] Field of Search ..... 345/89, 94, 95, 345/96, 208, 209, 210, 87, 147; 359/84, 86; 348/790, 792

[56] References Cited

U.S. PATENT DOCUMENTS 4,675,667 6/1987 Nakamura et al. ..... 345/96

5,517,212 5/1996 Inoue ..... 345/89

*Primary Examiner*—Regina D. Liang

*Attorney, Agent, or Firm*—Ronald L. Drumheller

[57] ABSTRACT

The generation of flicker is prevented when the contrast of a displayed image is changed. The amplitude of the data voltage whose polarity is inverted at a timing synchronized with the display cycle of an image is changed based on the tone and the designed contrast. At the same time, the position (center) of 0 V relative to the amplitude of the data voltage is offset a larger amount as the contrast increases. This corrects a change V in voltage between the electrodes under the influence of the parasitic capacity of a TFT when the TFT is turned off, so that the voltage between the electrodes is also turned off despite the polarity of the data voltage applied to the liquid crystal, even when the designated contrast is relatively high and the amplitude of the data voltage is relatively small, and even when the designated contrast is relatively low and the amplitude of the data voltage is relatively large.

3 Claims, 10 Drawing Sheets

METHOD AND APPARATUS FOR DRIVING A LIQUID CRYSTAL DISPLAY

BACKGROUND OF THE INVENTION

1. Field of the Invention

The present invention relates to a method and apparatus for driving a liquid crystal display, and more particularly to a method and apparatus for driving a liquid crystal display in which the liquid crystal device includes a liquid crystal cell which is formed by a switching element, a pair of transparent electrodes disposed so as to oppose each other and so as to be spaced apart at a predetermined distance, and a liquid crystal disposed between the pair of transparent electrodes; and an apparatus for driving the liquid crystal device to which the above method can be applied.

2. Related Art

Liquid crystal displays are conventionally known as a display device incorporated in information processors such as personal computers for displaying images like characters and figures. Liquid crystal displays are available in various constructions. However, in recent years, active matrix driven liquid crystal displays are widely used which employ a switching element such as a thin film transistor (TFT) which can control the tone of images and is suitable for rapidly moving animated images and color images. TFT liquid crystal displays provide, in a matrix, many pairs of mutually connected TFTs and transparent electrodes on one of the pair of transparent substrates disposed so as to oppose each other. The transparent substrate provides a plurality of gate lines for turning on each row of TFTs and a plurality of data lines for applying voltage to a liquid crystal via TFTs that have been turned on. Furthermore, on the entire opposite surface of the above pair of transparent substrates, a transparent common electrode is formed so that a liquid crystal is disposed between the pair of transparent substrates.

Images are displayed on TFT liquid crystal by applying a voltage to gate lines to turn on each row of TFTs one by one and by applying to a liquid crystal, via each data line, a voltage having a magnitude based on the tone of each pixel corresponding to the TFT row that has been turned on. When the TFT is turned on, the light transmittance rate in the liquid crystal changes based on the magnitude of the voltage. At the same time, an electrical charge is accumulated in the capacitance of the liquid crystal. After the TFT is turned off, the accumulated electric charge retains the changed state of the light transmittance rate. In addition, liquid crystals are characterized by shortening their lives when a voltage with the same polarity continues to be applied to them. Consequently, the light transmittance rate in liquid crystal displays becomes equal, despite different polarities, when the absolute value of the voltage is applied to liquid crystals. Such properties are used for prolonging the life of liquid crystals by inverting every frame the polarity of the voltage applied to liquid crystals via data lines for driving them.

Switching elements such as TFTs have a parasitic capacity, designated by the broken line in FIG. 10. The potential of electrodes connected to TFTs falls in voltage by $\Delta V$ due to the parasitic capacity after TFTs are turned off. Consequently, the absolute value of the voltage between electrodes decreases only by $\Delta V$ when a voltage with a positive polarity (polarity making the TFT side positive) is applied to the liquid crystal, as shown in FIG. 11. When a voltage with a negative polarity (polarity making the TFT side negative) is applied, the voltage increases by $\Delta V$. Since the light transmittance rate of liquid crystal changes with the variation in the absolute value of voltage between electrodes, a problem occurs in that liquid crystals deteriorate so that the variance in the absolute value is recognizable as a flicker or as a baking of the screen. Furthermore, it is known that the dielectric rate of the liquid crystal changes based on the absolute value of the voltage applied between electrodes. This causes the magnitude of $\Delta V$ to change according to the magnitude of voltage applied between electrodes, or the gradient. Consequently, for example, as described in PUPA 2-309318 and PUPA 2-217894, the applied voltage is raised by a predetermined quantity when a voltage with a positive voltage is applied to a liquid crystal, whereas the applied voltage is lowered by a predetermined quantity when a voltage with a negative polarity is applied to the liquid crystal. With the above construction, the position of 0 V (center) is lowered by $\Delta V$, as shown in FIG. 11, with respect to the frequency of the voltage between electrodes, shown in FIG. 11, based on the magnitude of the applied voltage or the tone of images. As a consequence, the voltage between electrodes assumed after a TFT is turned off becomes equal both when a voltage with a positive polarity is applied the liquid crystal and when a voltage with a negative polarity is applied thereto. As a result, the generation of flicker and the deterioration of the liquid crystal are prevented.

TFT liquid crystal displays are suitable for displaying rapidly moving animated cartoons and color images, they can be expected to be applied in a variety of uses. For example, the liquid crystal display has been studied for use as a large-scale monitor for use in workstations. To use TFT liquid crystal displays in place of CRT as monitor displays, the contrast of the displayed image must be adjustable. However, no active matrix driven liquid crystal displays using TFTs or the like enable contrast adjustment function or are constituted so as to prevent the generation of flickers.

When contrast adjustment is provided, the voltage applied to the liquid crystal must be changed based on the designated contrast and the amount of luminance adjustment. In this way, when the voltage applied to liquid crystals is changed based on the designated contrast, the dielectric rate of the liquid crystal changes as described above, resulting in a problem where the magnitude of voltage $\Delta V$ changes when the TFT is turned off and the liquid crystal deteriorates.

SUMMARY OF THE INVENTION

The present invention has been made in view of the above point, and the object of the invention is to provide a method and apparatus for driving a liquid crystal display device that can prevent the generation of flicker even when the contrast of images to be displayed is changed.

To attain the above object, the method for driving a liquid crystal display device in accordance with this invention is given as a method for driving a liquid crystal display in which said device includes a display cell which is formed by a switching element, a pair of transparent electrodes disposed so as to oppose each other and so as to be spaced apart at a predetermined distance, and a liquid crystal disposed between said pair of transparent electrodes, and the turning on of said switching element, the application of a voltage, which is of a predetermined polarity and of a magnitude corresponding to a tone displayed by said display cell, to said liquid crystal via said transparent electrodes and, thereafter, the turning off of said switching element for a predetermined time, are repeated as the polarity of the voltage applied to said liquid crystal cell is alternately reversed, so that an image is displayed, said method characterized such that:

the magnitude of the voltage applied to said liquid crystal is changed in accordance with the contrast of the image displayed on said liquid crystal display, and the magnitude of the changed applied voltage is corrected for each polarity so that an absolute value of the voltage between said pair of transparent electrodes when said switching element is turned off when the changed voltage is applied to said liquid crystal at a predetermined polarity and the absolute value of the voltage between said pair of transparent electrodes when said switching element is turned off when the changed voltage is applied at a polarity which is opposite to the predetermined polarity become equal.

The apparatus for driving the liquid crystal display device in accordance with this invention is given as an apparatus for driving a liquid crystal display in which said device includes a display cell which is formed by a switching element, a pair of transparent electrodes disposed so as to oppose each other and so as to be spaced apart at a predetermined distance, and a liquid crystal disposed between said pair of transparent electrodes, and the turning off of said switching element, the application of a voltage, which is of a predetermined polarity and of a magnitude corresponding to a tone displayed by said display cell, to said liquid crystal via said pair of transparent electrodes and, thereafter, the turning off of said switching element for a predetermined time, are repeated as the polarity of the voltage applied to said liquid crystal is alternately reversed, so that an image is displayed, said apparatus comprising:

a designation means for designating the contrast of an image to be displayed on a plurality of display cells;

a correction means for changing the magnitude of the voltage applied to the liquid crystal of each display cell based on the contrast of said image designated by said designation means, and correcting the magnitude of said changed voltage for each polarity so that the absolute value of the voltage between said pair of transparent electrodes becomes equal when the switching element is turned off when said changed voltage is applied to a liquid crystal with a predetermined polarity and when said changed voltage is applied to a liquid crystal with a polarity opposite to said polarity.

To change the contrast in a liquid crystal display device, it is necessary to change the magnitude of the voltage applied to the liquid crystal corresponding to each tone of the display image. When the magnitude of the applied voltage is changed corresponding to each tone, the amount of variance of the voltage between transparent electrodes changes after the switching element is turned off, even in the same tone, and flicker is generated even if the voltage applied to the liquid crystal via a pair of transparent electrodes is corrected for each tone in a fixed manner as in a conventional device.

Consequently, in this invention, the magnitude of the voltage applied to the liquid crystal is changed based on the contrast of the image displayed on the liquid crystal display device, and the magnitude of the changed applied voltage is corrected for each polarity so that the absolute value of the voltage between the pair of transparent electrodes becomes equal when the switching element is turned off when the changed voltage is applied to the liquid crystal with the predetermined polarity and when the changed voltage is applied to the liquid crystal with a polarity opposite to the predetermined polarity.

With such a construction, if the contrast in an image displayed in a liquid crystal display device is changed, the magnitude of the voltage applied to the liquid crystal is changed, and the changed voltage is corrected for each polarity so that the absolute value of the voltage between the pair of transparent electrodes when the switching element is turned off when the voltage is applied with the predetermined polarity and when the voltage is applied to the liquid crystal with a polarity opposite to the predetermined polarity, thereby preventing the generation of flicker in a liquid crystal corresponding to each tone of the displayed image and thereby preventing the deterioration of the liquid crystal.

In accordance with the present invention, when the switching element is turned off, a change in the voltage is generated between electrodes. Generally, in liquid crystal display devices, a plurality of switching elements is subsequently turned on for each group connected to the same gate line. The time in which individual switching elements are turned on is very short compared with the time in which the switching element is turned off, so the change in voltage between electrodes is not recognized as flicker when the switching element is turned off.

The invention also preferably provides a designation means for designating the contrast of the image displayed on a plurality of display cells in the liquid crystal display device to change the magnitude of the voltage applied to the liquid crystal in each display cell based on the contrast in the image designated by the designation means and to correct the magnitude of the changed voltage for each polarity so that the absolute value of the voltage between transparent electrodes when the switching element is turned off when the changed voltage is applied to the liquid crystal with the predetermined polarity and when the voltage is applied to the liquid crystal with the polarity opposite to the predetermined polarity. With such construction, the generation of flicker can be prevented, even when the contrast of the displayed image is changed.

BRIEF DESCRIPTION OF THE DRAWINGS

FIG. 2 is a schematic view showing a circuit of a liquid crystal display, a driver connected to the liquid crystal display, and the like;

DESCRIPTION OF THE PREFERRED EMBODIMENTS

Figure 1:
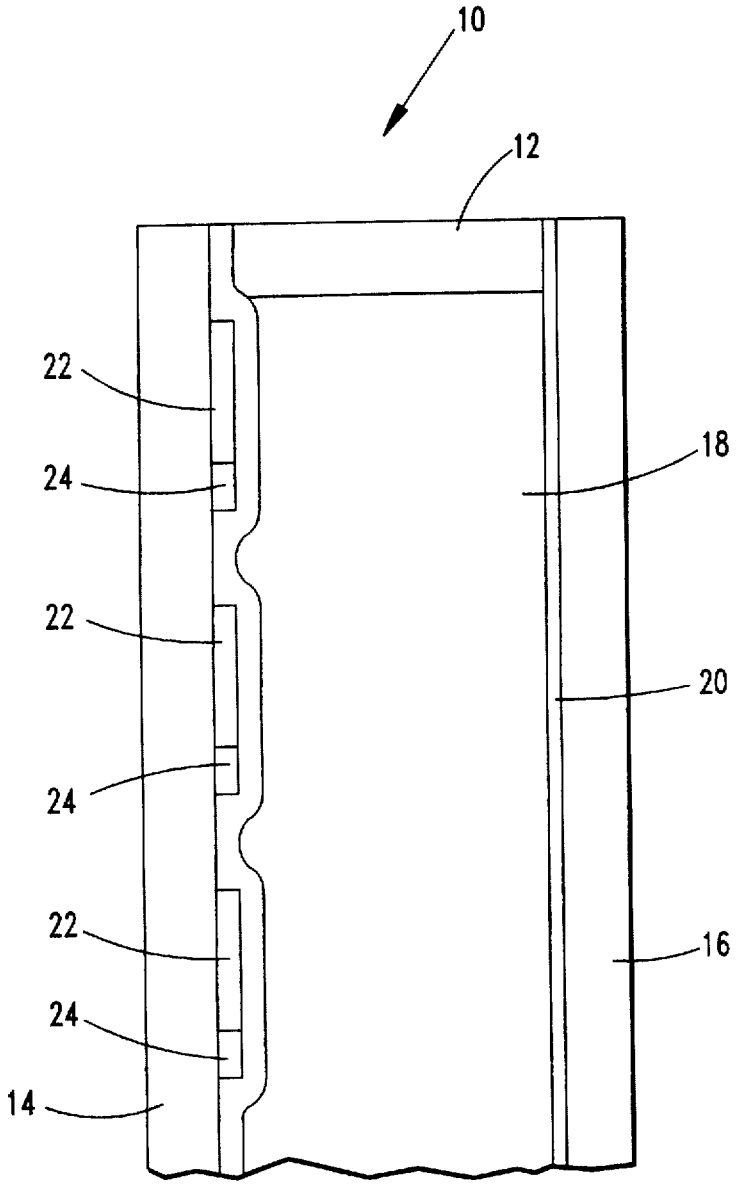
FIG. 1 is a sectional view of a liquid crystal display of the present invention.

An embodiment of the present invention is detailed below in conjunction of the drawings. FIG. 1 is a sectional view of a liquid crystal display 10 of the present invention.

The liquid crystal display 10 provides a pair of transparent substrates 14, 16 disposed to oppose each other and to be spaced apart a predetermined distance by the spacer 12. A liquid crystal 18 is disposed between the transparent substrates 14, 16. In accordance with the present invention, TFTs 24 are disposed in a matrix (FIG. 2) on the surface of the transparent substrate (TFT) 24 contacting the liquid crystal 18 of the transparent substrate 14, and an electrode 22 is provided corresponding to each of the TFTs 24.

Figure 2:
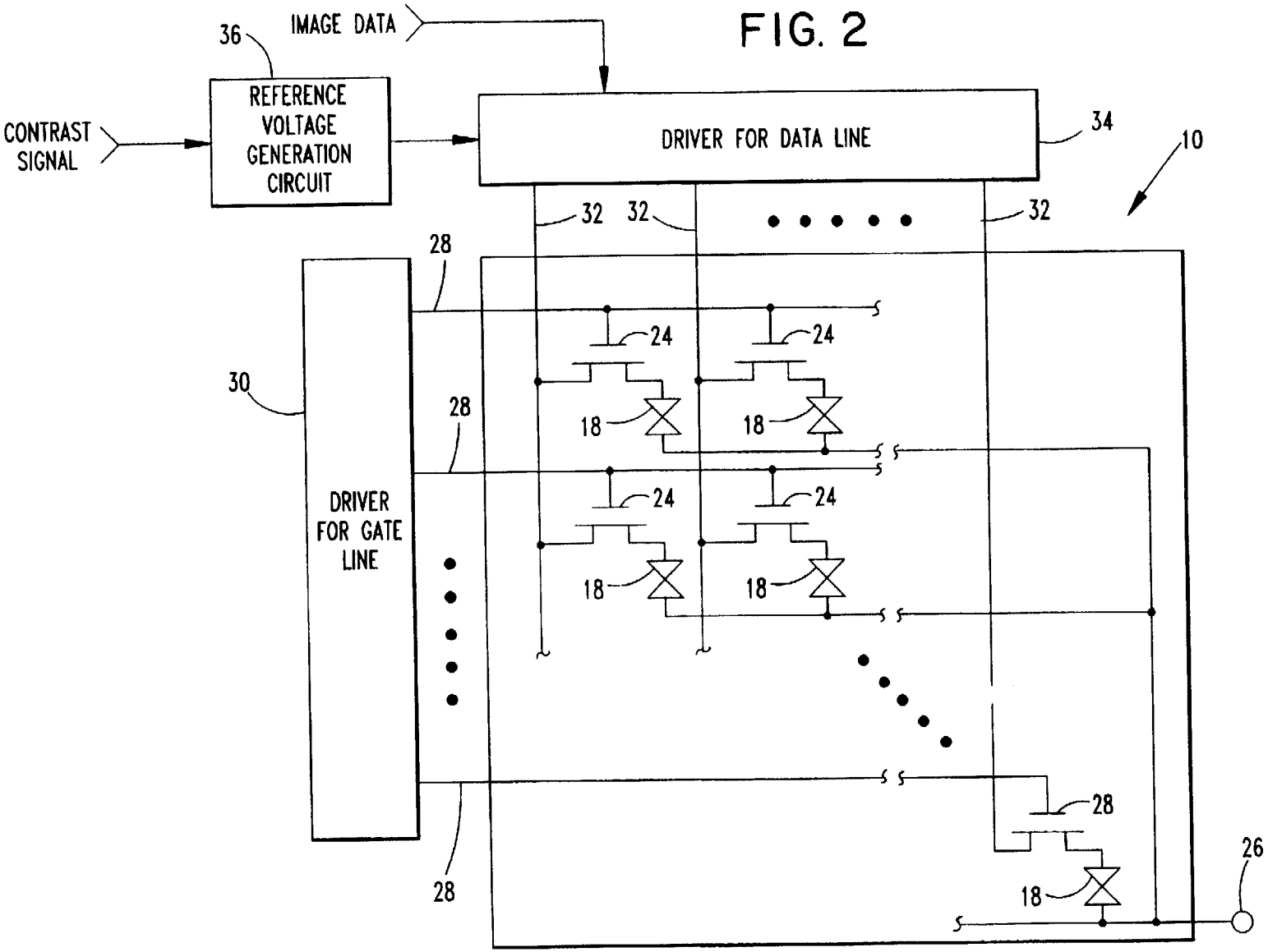

FIG. 2 schematically shows a circuit of a liquid crystal display 10. Although the circuit is not shown in the drawings, the above described electrode 22 is connected to each source of each TFT 24. The liquid crystal 18 is sandwiches between the two electrodes 22, 20 (FIG. 2 shows the electrode 20 as wiring extending from one end of the liquid crystal 18 shown in plurality therein to a common terminal 26). The liquid crystal 18 shown in plurality in FIG. 2 corresponds to one pixel of an image displayed on a liquid crystal display 10. The liquid crystal 18, TFT 24, and electrodes 22, 20 together constitute a display cell of the present invention. Also in accordance with the present invention, the common terminal 26 connected to the electrode 20 is grounded, and the potential of the electrode 20 is set to a definite level (ground level).

The liquid crystal display 10 provides a plurality of gate lines 28 extending in a predetermined direction on the side of the transparent substrate 14. The gate of each TFT 24 is connected to any one of the plurality of gate lines 28. Each of the gate lines 28 is connected to the driver 30 of the gate line. When an image is displayed on the liquid crystal display 10, the gate line driver 30 is arranged in such a manner where the voltage that turns on TFT 24 connected to the gate line 28 is applied for a predetermined time and the gate line that applies the voltage is subsequently shifted for each predetermined time.

In addition, on the side of the transparent substrate 14 of the liquid crystal display 10, a plurality of data lines 32 is provided which extends in direction intersecting the gate line 28, the drain of each TFT 24 being connected to any of the plurality of data lines 32. Data lines 32 are connected to the driver 34 of data lines. Image data expressing the tone of one pixel with a predetermined bit (for example, 3 bits) is input to the driver 34 of the data line in one-pixel rows. In addition, the reference voltage generation circuit 36 is connected to the data line driver 34.

The reference voltage generation circuit 36 provides a tone voltage generation and correction circuit 38 (see FIG. 3) for the same number as the number of tones (for example, when image data is given in 3 bits, the number of tones becomes $2^3=8$) in image data. The input end 38A of the tone voltage generation and correction circuit 38 is connected to the inversion input end of an operation amplifier 42 via resistor 40. A tone signal of a voltage level corresponding to each of the tones is input to the input end 38A of the tone voltage generation and correction circuit 38. The tone signal assumes a higher voltage level with the lower light transmittance rate of the respective tone in the liquid crystal. The inversion input end of the operation amplifier 42 is connected to the output end of the operation amplifier 42 via resistor 48, and is further connected to the output end of a contrast signal generation section 46 via a resistor 44.

Figure 5:
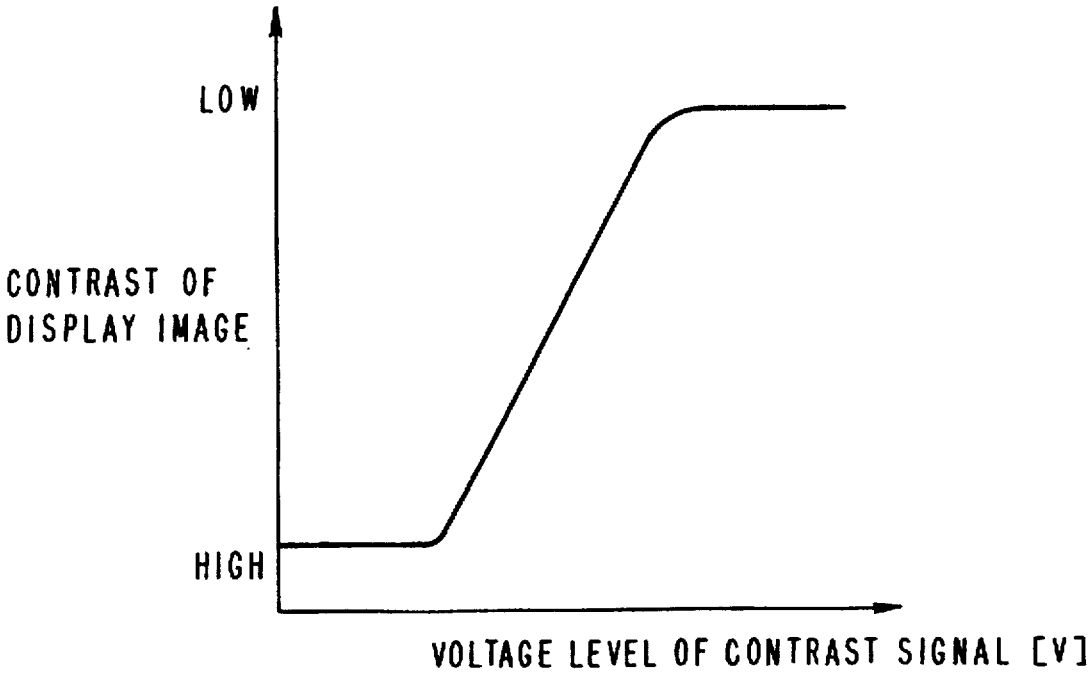
FIG. 5 is a linear diagram showing the relationship between the contrast of the designated display image and the voltage level of the contrast signal.

The contrast signal generation section 46 provides a contrast adjustment dial (not shown in the drawings) for designating the contrast of the image user's display on the liquid crystal display 10. As shown in FIG. 5, an output contrast signal falls in voltage along with the increase in a higher contrast designated via the contrast adjustment dial. In addition, the noninversion input end of the operation amplifier 42 is grounded. The output end of the operation amplifier 42 is connected to the inversion input end of the operation amplifier 52 via resistor 50. The inversion input end of the operation amplifier 52 is connected to the output end of the operation amplifier 52 via resistor 54. The noninversion input end of the operation amplifier 52 is grounded. The voltage resistance values in resistors 40, 44, 48, 50, and 54 are equalized in the present embodiment.

Figure 3:
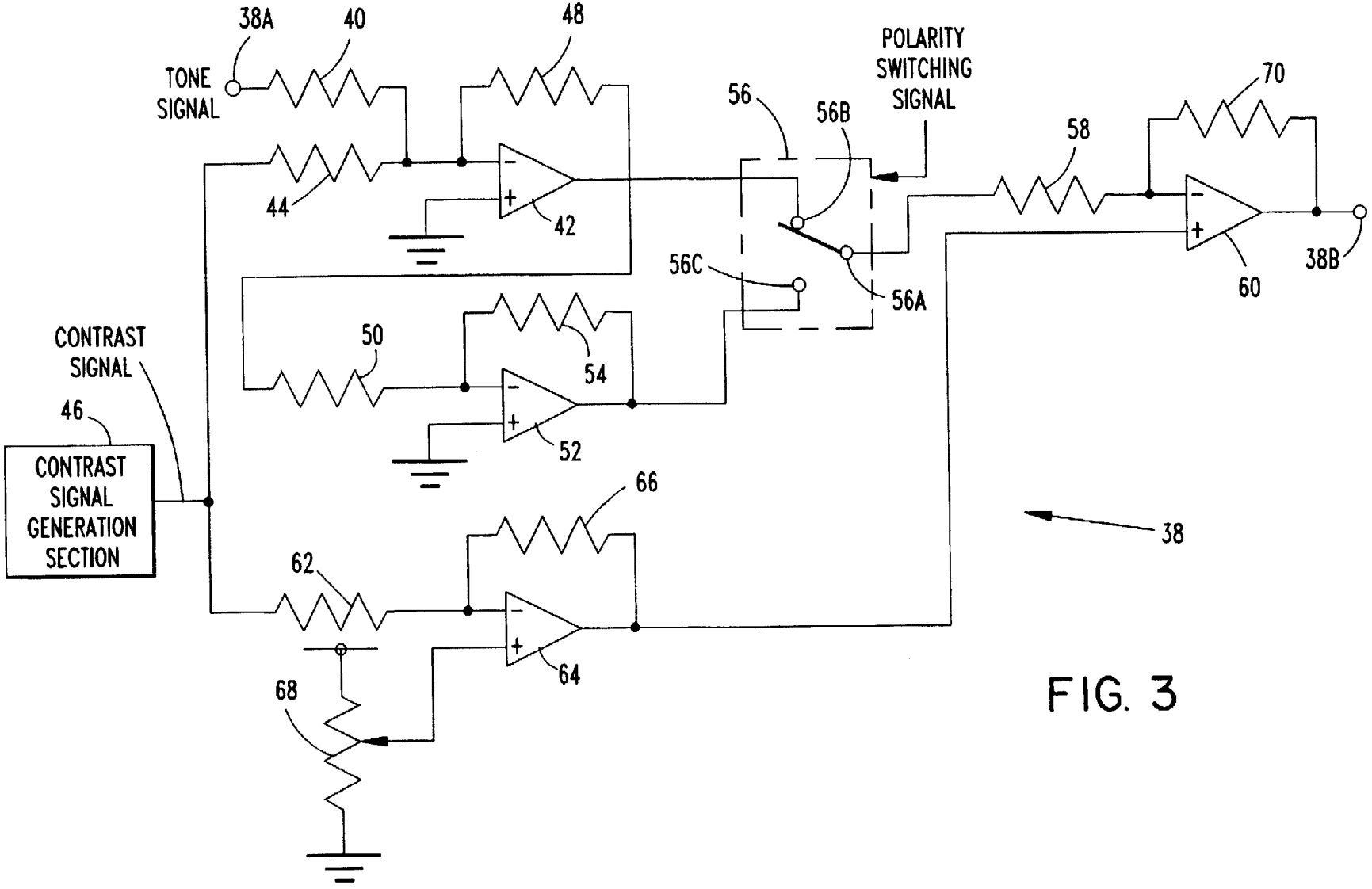
FIG. 3 is a circuit diagram showing an example of the construction of a tone voltage generation and correction circuit of one embodiment of the present invention.

The output end of operation amplifiers 42 and 52 is connected to terminals 56B and 56C of the polarity switch 56. FIG. 3 conceptually shows the polarity switch 56 as a mechanical switch. In actuality, the polarity switch 56 includes a switching element such as transistors. For example, each time an image is displayed in one frame of the liquid crystal display 10, the terminal connected to the common terminal 56A is shifted to the terminal 56B or the terminal 56C based on the polarity shift signal formed from a synchronous signal. The common terminal 56A is connected to the inversion input end of the operation amplifier 60 via resistor 58.

The output end of the contrast signal generation section 46 is connected to the inversion input end of the operation amplifier 64 via resistor 62. The inversion input end of the operation amplifier 64 is connected to the output end of the operation amplifier 64 via the resistor 66. The noninversion input end of the operation amplifier 64 is connected to a movable element of a variable resistor 68 whose one end is connected to the power source and the other end is grounded. The output end of the operation amplifier 64 is connected to the noninversion input end of the operation amplifier 60. The inversion input end of the operation amplifier 60 is connected to the output end of the operation amplifier 60 via resistor 70. The output end of the operation amplifier 60 is connected to the tone voltage generation and the output end 38B of correction circuit 38. Voltage resistance values in the resistor 58 and the resistor 70 are made equal in the present embodiment.

The output end 38B of the tone voltage generation and correction circuit 38 is connected to the driver 34 of the data lines. The reference voltage corresponding to each tone is input to the driver 34 of data lines. Consequently, a reference voltage having the same number of tones as image data is input from the reference voltage generation circuit 36 to the driver 34 of data lines. The driver 34 of data lines supplies, to the data line 32 corresponding to each pixel, the reference voltage supplied from the tone voltage generation and correction circuit 38 corresponding to the tone of each of pixels which constitute one pixel row expressed by the input image.

The operation of the embodiment is explained next. A tone signal of the voltage level corresponding to each of the tone voltage generation and correction circuit 38 is input via resistor 40 to the inversion input end of the operation amplifier 42 of the tone voltage generation and correction circuit 38 and, at the same time, a contrast signal is input via resistor 44. The operation amplifier 42 functions as an adder in which electrical values for resistors 44 and 48 are made equal. When the voltage level of the tone signal is designated by $V_G$ and the voltage level of the contrast signal is designated by $V_{con}$, the voltage level of the output signal in the operation amplifier 42 becomes $-(V_G+V_{con})=-V_1$. The absolute value of the voltage level increases with the lower light transmittance rate of the liquid crystal represented by the corresponding tone. At the same time, a signal is output which uses the larger absolute value of the voltage level as the contrast represented by the contrast signal. The output signal of this operation amplifier 42 is input to the inversion input end of the operation amplifier 52 via resistor 50.

Figure 6B:
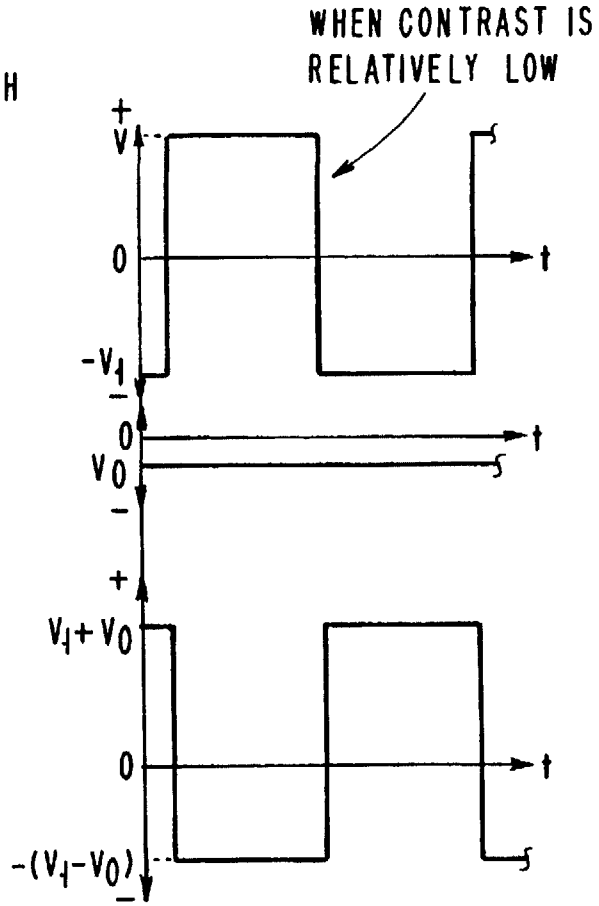
FIGS. 6A and 6B are a linear diagram showing the change in the signal output from a polarity switch 56 and operation amplifiers 64, 60 in the tone voltage generation and correction circuit, FIG. 6A showing a case in which the contrast is relatively high, and FIG. 6B showing a case in which the contrast is relatively low.
Figure 6A:
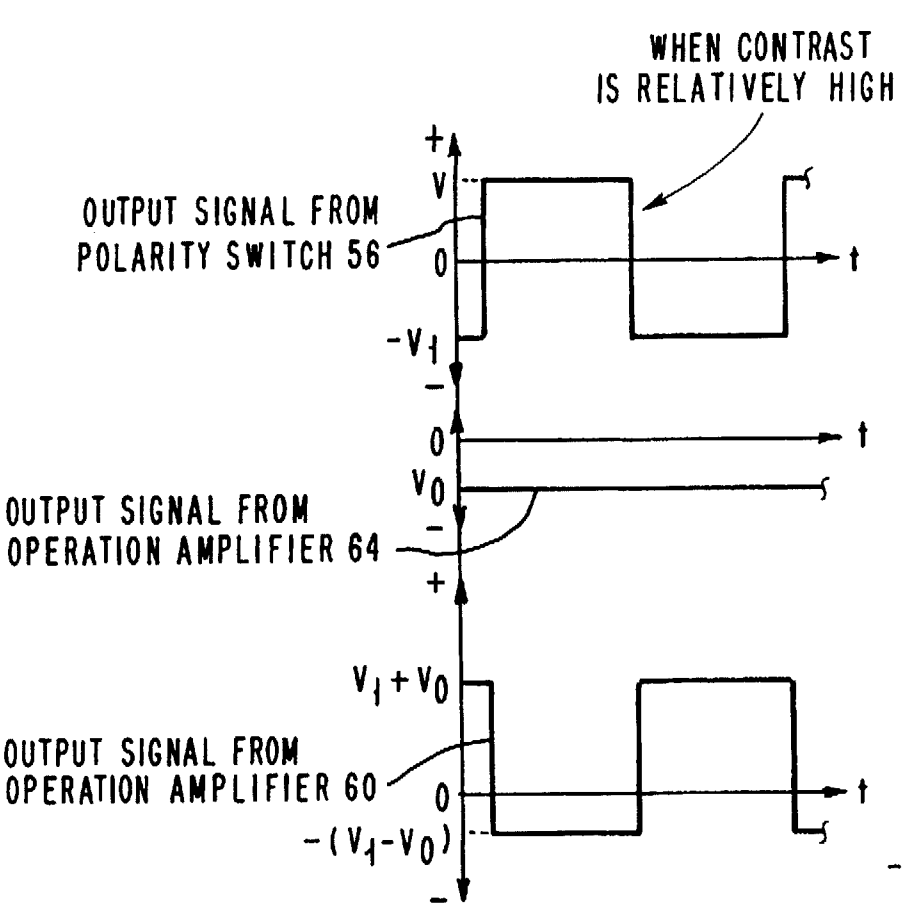

The operation amplifier 52 functions as an inversion circuit in which the electrical resistance value of resistors 50 and 54 is made to equal that of resistors 44 and 48. The voltage level of the output signal of the operation amplifier 52 becomes $(V_G+V_{con})=V_1$. As described above, the absolute value of the voltage level increases as the light transmittance rate of liquid crystal represented by the corresponding tone decreases. At the same time, a signal is output which provides a larger absolute voltage level value as the contrast represented by the contrast signal decreases. The polarity switch 56 switches the terminal connected to the common terminal 56A either to the terminal 56B or to the terminal 56C each time one frame of an image is displayed on the liquid crystal display 10. As one example, as shown in FIG. 6, the output signal from the operation amplifier 42 and the output signal from the operation amplifier 52 are output alternately. A signal output from the polarity switch 56 is input to the inversion input end of the operation amplifier 60 via resistor 58.

A contrast signal output from the contrast signal generation section 46 is input to the inversion input end of the operation amplifier 64 via resistor 62. Furthermore, the reference voltage $V_{ref}$ is input to the noninversion input end of the operation amplifier 64 via a variable resistor 68. The variable resistor 68 is adjusted so that the reference voltage $V_{ref}$ decreases as the light transmittance rate of the liquid crystal represented by the tone to which the tone voltage generation and correction circuit 38 corresponds. The operation amplifier 64 functions as a differential amplifier and the voltage level of a signal output from the operation amplifier 64 becomes $V_0=(V_{ref}-V_{con}\times(R_{66}+R_{62}))$. (However, $R_{66}$ designates the voltage resistance value for resistor 66 and $R_{62}$ voltage resistance value of resistor 62.) A signal (hereafter, the correction voltage) is output which decreases the voltage level (absolute value decrease) as the designated contrast drops.

The correction voltage output from the operation amplifier 64 is input to the noninversion input end of the operation amplifier 60. The voltage level output from the signal output from the operation amplifier 60 becomes $V_1+V_0$ when a signal of the voltage level $-V_1$ is input from the operation amplifier 42 via the polarity switch 56. When a signal of the voltage level $-V_1$ is input from the operation amplifier 52 via the polarity switch 56, the voltage level becomes $-V_1+V_0$. Consequently, a voltage is output in which a signal output from the polarity switch 56 is corrected with the correction voltage $V_0$.

In addition, the correction voltage $V_0$ is changed in accordance with the contrast designated as described above. When the correction voltage $V_0$ is designated to heighten the contrast, the amplitude of the voltage (absolute value of voltage level $V_1$) of a signal output from the polarity switch 56 decreases as FIG. 6(A. At the same time, the absolute value of correction voltage $V_0$ becomes larger, and the voltage level of a signal output from the operation amplifier 60 is corrected with a large correction amount (namely, the absolute value of correction voltage $V_0$) by the correction voltage $V_0$ whose absolute value is made larger, as apparent from FIG. 6B.

The above signal output from the operation amplifier 60 is supplied as the reference voltage to the driver 34 of data lines. The driver 30 of the gate line applies voltage that turns on the TFT 24 a predetermined time to any one of a plurality of gate lines 28. At the same time, the gate line 28 that applies the above voltage is subsequently switched for each predetermined time. Image data which expresses the tone of each pixel in the pixel row corresponding to the gate line to which the voltage is applied is input to the driver 34 of the data line in synchronization with the timing when the gate line driver 30 switches the gate line applying the voltage so that the reference voltage supplied from the tone voltage generation and correction circuit 38 corresponding to the tone of each said pixel is supplied as data voltage to the data line 32 corresponding to each pixel based on the tone of each pixel.

Figure 7B:
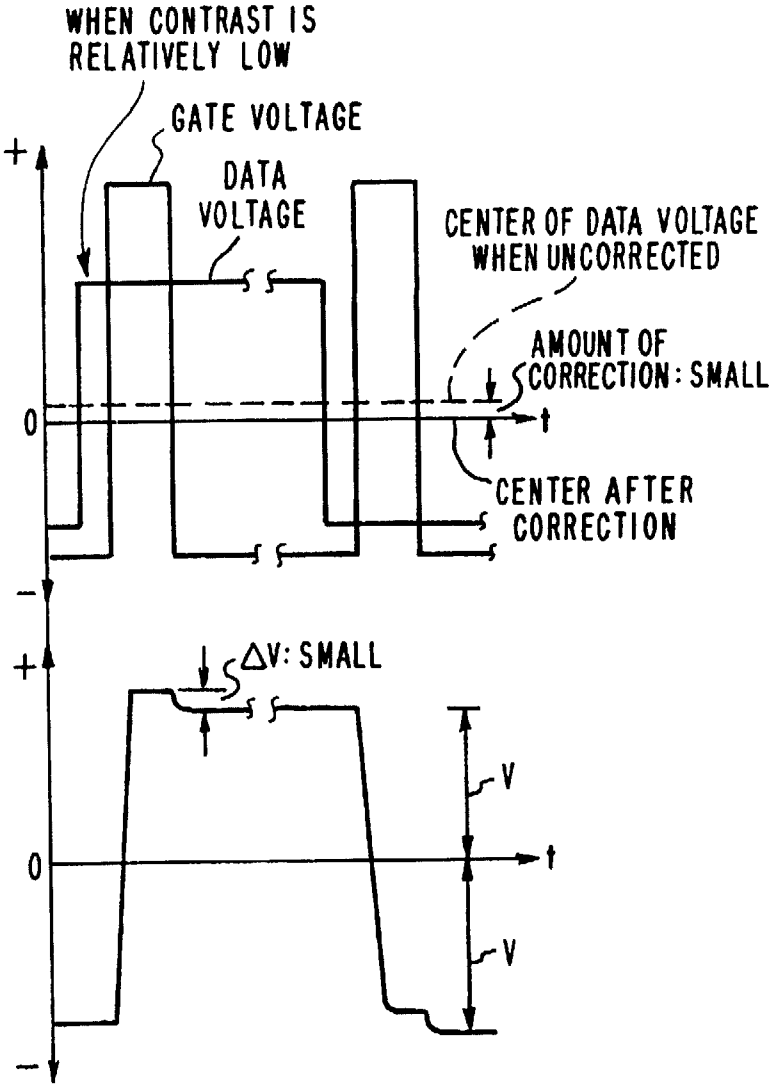
FIGS. 7A and 7B are a linear diagram showing a change in voltage between the data voltage, gate voltage, and electrodes, 7A showing a case in which the contrast is relatively high, and 7B showing a case in which the contrast is relatively low.
Figure 7A:
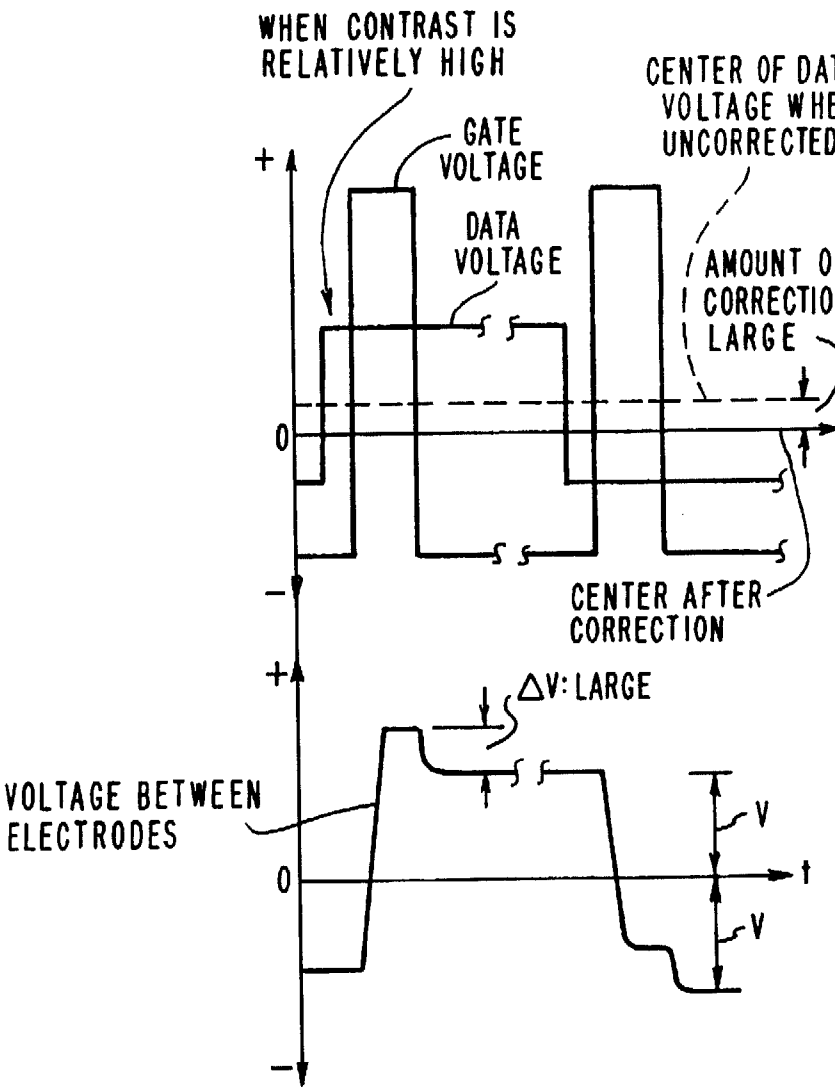

Here, as shown in FIG. 7A, when voltage is applied to a predetermined gate line 28 while the data voltage has a positive polarity, TFT 24 connected to the predetermined gate line 28 is turned on so that the data voltage with a positive polarity is applied to electrodes 22, 20 and the voltage between electrodes rises to a predetermined level corresponding to the positive amplitude of the data voltage. Consequently, the light transmittance rate in the liquid crystal 18 disposed between the electrodes changes along with the voltage level applied between electrodes. At the same time, electrical charge is accumulated in the capacitance of the liquid crystal 18. After a predetermined time passes after the application of the voltage to the predetermined gate line starts, the application of the voltage to the predetermined gate line is terminated and the TFT 24 is turned off. When the TFT 24 is turned off, the voltage between electrodes decreases to the voltage V by the parasitic capacity and the dielectric rate of the liquid crystal 18 by $\Delta V$ due to the influence of the TFT 24 so that the state applied with the voltage V is substantially maintained between the electrodes while TFT 24 is on.

One frame of an image is displayed on the liquid crystal display 10, a connection point of the polarity switch 56 in the tone voltage generation and correction circuit 38, the polarity of the data voltage is inverted. When a voltage is applied to the predetermined gate line 28 while the data voltage has a negative polarity, the TFT 24 is turned on and the negative data voltage is applied between electrodes 22, 20 so that the voltage between electrodes decreases to a predetermined level corresponding to the negative amplitude of the data voltage. When the TFT 24 is turned off after a predetermined time, the voltage between electrodes further decreases by $\Delta V$.

The data voltage is set to the amplitude corresponding to the tone and contrast in the tone voltage generation and correction circuit 38 as described above. Furthermore, the amplitude is corrected for each polarity with the correction voltage $V_0$ whose absolute value changes based on the contrast so that the position of 0 V is offset to the amplitude of the data voltage. Consequently, when the TFT 24 is turned off after the data voltage of negative polarity is applied between the electrodes, the section between the electrodes is kept in a state in which voltage −V is applied. This voltage has the same absolute value as the voltage between electrodes when the TFT 24 is turned off after a positive data voltage is applied between positive electrodes. Thus, the voltage between electrodes becomes equal after the TFT 24 is turned off despite the polarity of the voltage applied between electrodes. As a consequence, the light transmittance rate of the liquid crystal 18 is kept at a definite value, no flicker is recognized, and the deterioration of the liquid crystal 18 is prevented.

Furthermore, when the contrast is heightened, the amplitude of the data voltage drops with the increase in the contrast as shown in FIG. 7A. At the same time, a larger correction voltage $V_O$ enlarges the offset amount of the center of the data voltage. As a result, when the absolute value of the data voltage is made small, the above $\Delta V$ becomes larger. However, the change in $\Delta V$ is corrected and the absolute value of the voltage between electrodes after the TFT 24 is turned off despite the polarity of the voltage applied between electrodes. The variable resistor 68 is adjusted based on each tone in the tone generation and correction circuit 38, and the absolute value of the correction voltage $V_O$ output from the operation amplifier 64 corresponding to the predetermined contrast differs based on the tone corresponding to each circuit 38. Thus, even when a reference signal output from any of the tone generation and correction circuits 38 is applied to the data line 32, the voltage between electrodes after the TFT 24 is turned off despite the polarity of the voltage applied between electrodes becomes equal.

Figure 8:
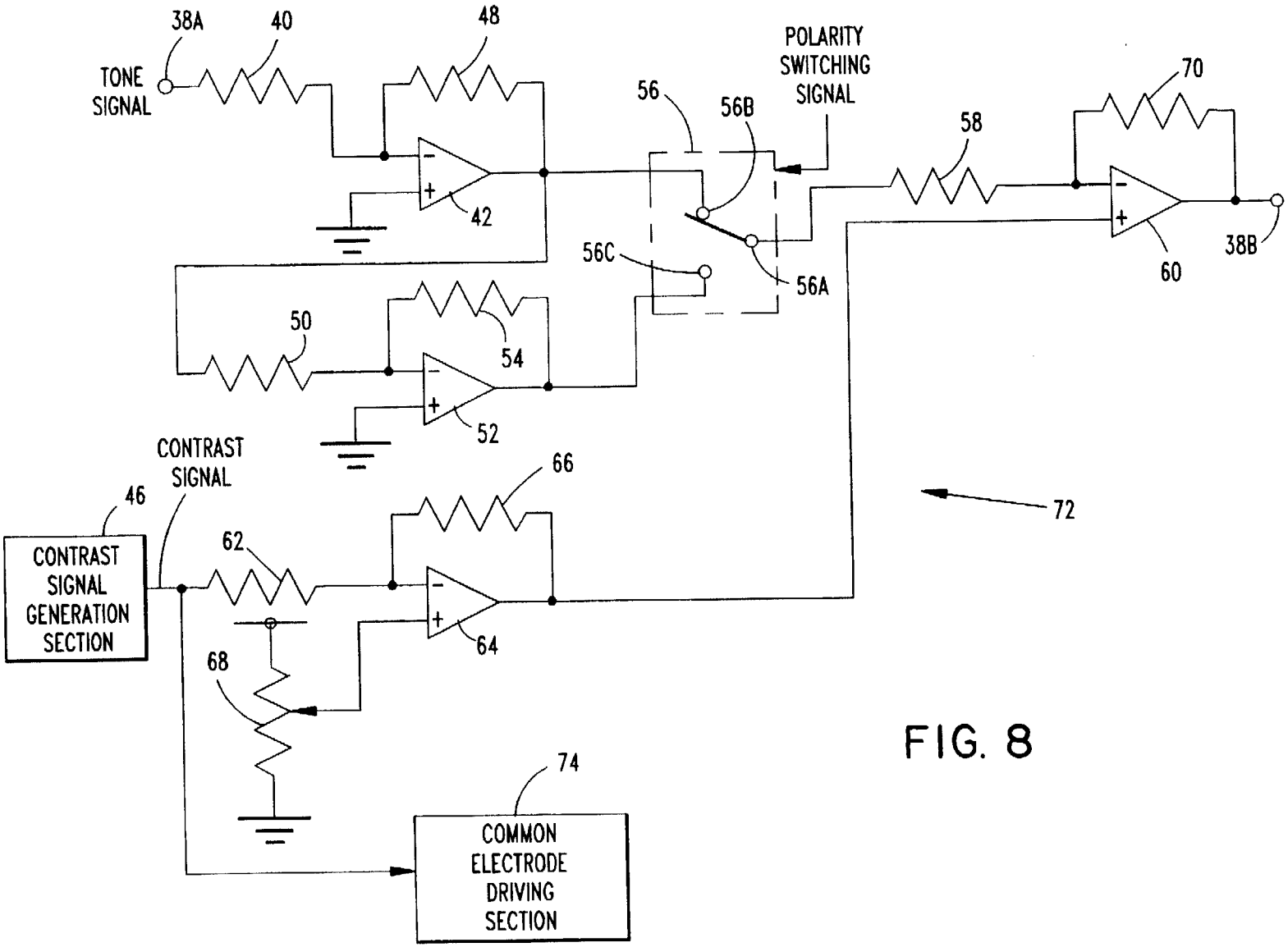
FIG. 8 is a circuit diagram showing another embodiment of the tone voltage generation and correction circuit.

Other constructions of the tone generation and correction circuit will be explained next. Similar parts of the tone voltage generation and correction circuit 38 shown in FIG. 3 are designated by the same symbols, and a detailed description thereof is omitted here. In the tone voltage generation and correction circuit 72 as FIG. 8, each of the noninversion input ends of operation amplifiers 42, 52 are grounded. The absolute value $V_1$ of the voltage level of a signal output from the operation amplifiers 42, 52 assumes a definite value based on the tone. The reference voltage (data voltage) output from the operation amplifier 60 changes only at the center thereof with correction voltage $V_O$ which changes with the contrast thereof.

Figure 9B:
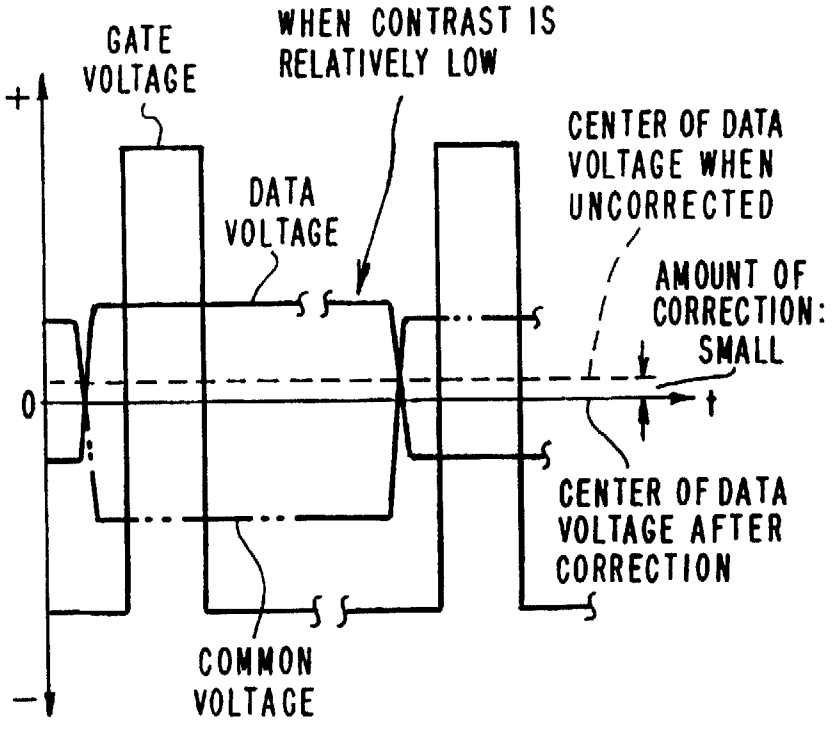
FIGS. 9A and 9B are a linear diagram showing the change in data voltage, gate voltage, and common voltage when using the tone voltage generation and correction circuit as FIG. 8, 9A showing a case in which the contrast is relatively high, and 9B showing a case in which the contrast is relatively low.
Figure 9A:
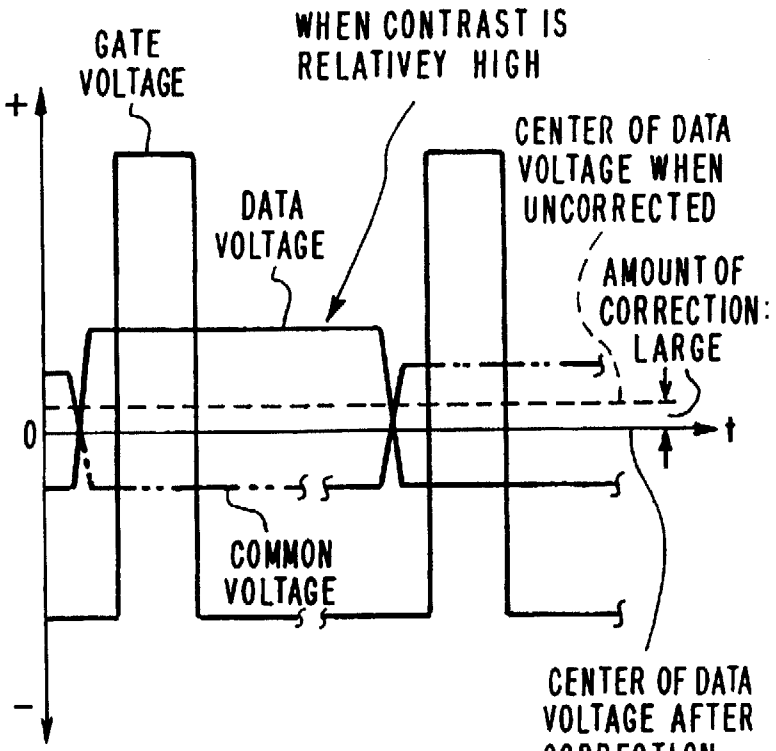
Figure 10:
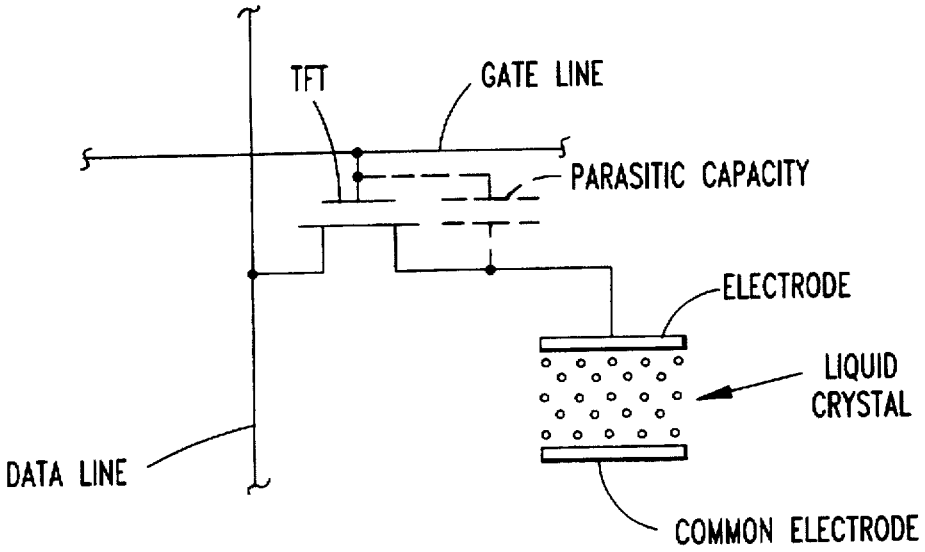
FIG. 10 is a view showing the parasitic capacity of TFT.
Figure 11:
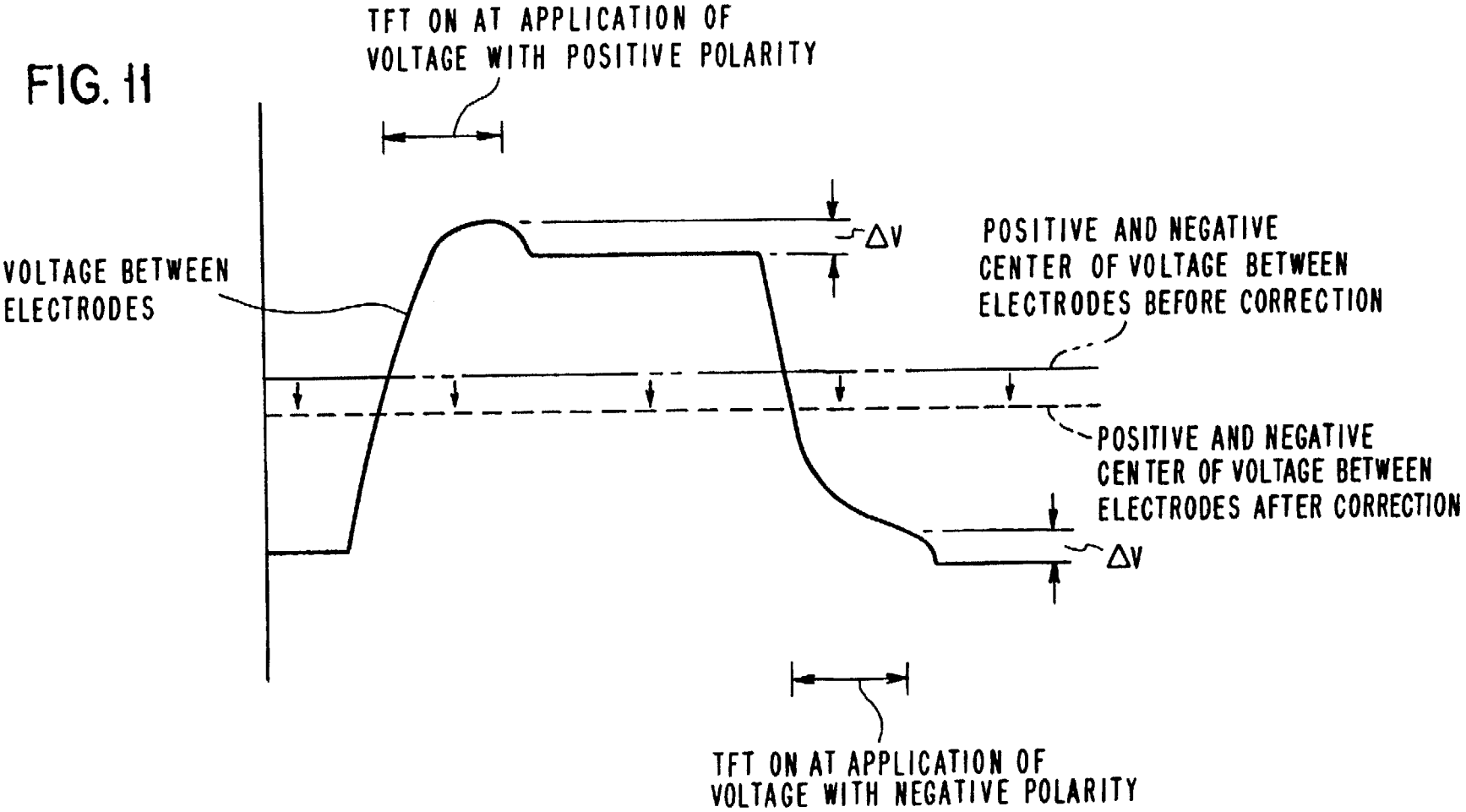
FIG. 11 is a linear diagram conceptually showing the change in the voltage between electrodes when an image is displayed on the liquid crystal display and a change in correction based on the tone of the voltage applied to the liquid crystal.

The output end of the contrast signal generation section 46 is connected to the input end of the common electrode driving section 74. The output end of the common electrode driving section 74 is connected to the common terminal 26 of the electrode 20 (not shown in the drawings). In the same manner as for the polarity switch 56, a polarity switch signal is input to the common electrode driving section 74 to control the voltage of the electrode 20 to provide a polarity opposite to the polarity of the data voltage, shown as the common voltage in FIG. 9, based on the polarity switching signal. As shown in FIGS. 9A and 9B, the voltage of the electrode 20 is controlled so that the amplitude of the common voltage becomes larger as the contrast drops (the contrast signal voltage level becomes higher).

Since the difference between the data voltage and common voltage is applied between electrodes 22, 20, the magnitude of the voltage applied to the liquid crystal 18 with a positive polarity and the magnitude of the voltage applied to the liquid crystal 18 with a negative polarity changes in the same manner as the tone voltage generation and correction circuit 38 along with the change in contrast. This prevents the recognition of flicker and the deterioration of the liquid crystal 18.

In the previous section, a case was explained using a TFT as a switching element that turns voltage applied to the liquid crystal on and off. However, it is possible to apply the driving apparatus of the present invention to a case in which a type of switching element is used as the above switching element in which parasitic capacity resides.

Figure 4:
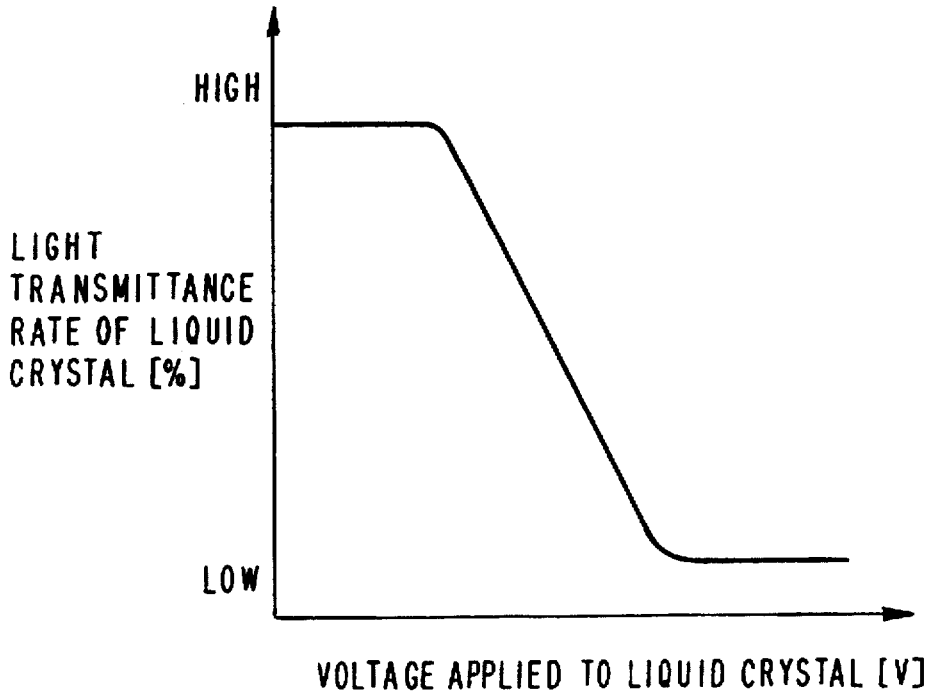
FIG. 4 is a linear representation showing the relationship between the voltage applied to a liquid crystal and the light transmittance rate of the liquid crystal.

As shown in FIG. 4, a case is explained in which a liquid crystal was used which has a negative dielectric anisotropy which lowers the light transmittance rate along with the increase in the applied voltage. However, the present invention is not limited to this. It is also possible to apply the present invention to a case in which a liquid crystal is used which has a positive dielectric anisotropy which rises with an increase in the applied voltage. When such a liquid crystal is used, correction must be made to enlarge the correction as the contrast drops. When the relationship between the contrast of the designated image as shown in FIG. 5 and the voltage level of the contrast signal is set so that the voltage level of the contrast signal is raised with the increase in the designated contrast, it is possible to cope with the change in contrast without changing the circuit construction shown in FIGS. 3 and 8.

Furthermore, in the above description, a display cell comprising a TFT 24, electrodes 20, 22, and a liquid crystal 18 was explained as an example. A display cell having a construction in which a capacitor is connected in parallel to the liquid crystal 18 may be used. In addition, in the foregoing description, the polarity of the data voltage may be inverted for each display of one image frame. However, the polarity of the data voltage may be inverted for each display of one pixel row.

As described above, the invention effectively prevents the generation of flicker even when the contrast of an image to be displayed is changed because the magnitude of the voltage applied to the liquid crystal is changed based on the contrast of the image displayed on a liquid crystal display device, and the magnitude of the changed applied voltage is corrected for each polarity so that the absolute value of the voltage between a pair of transparent electrodes becomes equal when a switching element is turned off when the changed voltage is applied to the liquid crystal with the predetermined polarity and when the changed voltage is applied to the liquid crystal with the polarity opposite to the predetermined polarity.

The invention also effectively prevents flicker even when the contrast of an image to be displayed is changed because the liquid crystal display comprises a designation means for designating the contrast of an image to be displayed on a plurality of display cells of the liquid crystal display device. The correction means changes the magnitude of the voltage applied to the liquid crystal of each display cell based on the contrast of an image designated by the designation means, and the magnitude of the changed voltage is corrected for each polarity so that the absolute value of the voltage between a pair of transparent electrodes becomes equal when a switching element is turned off when the changed voltage is applied to the liquid crystal with the predetermined polarity, and when the changed voltage is applied to the liquid crystal with the polarity opposite to the predetermined polarity.

We claim:

1. A method for driving a liquid crystal display in which a liquid crystal display device includes a display cell which is formed by a switching element, a pair of transparent electrodes disposed so as to oppose each other and so as to be spaced apart at a predetermined distance, and a liquid crystal disposed between said pair of transparent electrodes.

and wherein the turning on of said switching element, the application of voltage, which is of a predetermined polarity and of a magnitude corresponding to a tone displayed by said display cell, to said liquid crystal via said transparent electrodes and, thereafter, the turning off of said switching element for a predetermined time, are repeated as the polarity of the voltage applied to said liquid crystal is alternately reversed, so that an image is displayed, said method being characterized in that: designating the contrast of an image to be displayed, the magnitude of the voltage applied to said liquid crystal is changed in accordance with a specified contrast for the image to be displayed on said liquid crystal display, and the magnitude of the changed applied voltage is corrected for each polarity by an amount also based on the contrast of said image specified by said designating step so that an absolute value of the voltage between said pair of transparent electrodes when said switching element is turned off when the changed voltage is applied to said liquid crystal at a predetermined polarity and the absolute value of the voltage between said pair of transparent electrodes when said switching element is turned off when the changed voltage is applied at a polarity which is opposite to the predetermined polarity become equal.

2. An apparatus for driving a liquid crystal display in which the liquid crystal display includes a plurality of display cells each of which is formed by a switching element, a pair of transparent electrodes disposed so as to oppose each other and so as to be spaced apart at a predetermined distance, and a liquid crystal disposed between said pair of transparent electrodes, and wherein the turning on of said switching element, the application of voltage, which is of a predetermined polarity and of a magnitude corresponding to a tone displayed by said display cell, to said liquid crystal via said pair of transparent electrodes and, thereafter, the turning off of said switching element for a predetermined time, are repeated as the polarity of the voltage applied to said liquid crystal is alternately reversed, so that an image is displayed, said apparatus comprising:

a designation means for designating the contrast of an image to be displayed;

a correction means for changing the magnitude of the voltage applied to the liquid crystal of each display cell based on the contrast of said image designated by said designation means, and for correcting the magnitude of said changed voltage for each polarity so that the absolute value of the voltage between said pair of transparent electrodes becomes equal when the switching element is turned off when said changed voltage is applied to a liquid crystal with a predetermined polarity and when said changed voltage is applied to a liquid crystal with a polarity opposite to said predetermined polarity.

3. An apparatus for driving a liquid crystal display in which the liquid crystal display includes a plurality of display cells each of which is formed by a switching element, a pair of transparent electrodes disposed so as to oppose each other and so as to be spaced apart at a predetermined distance, and a liquid crystal disposed between said pair of transparent electrodes, and wherein the turning on of said switching element, the application of voltage, which is of a predetermined polarity and of a magnitude corresponding to a tone displayed by said display cell, to said liquid crystal via said pair of transparent electrodes and, thereafter, the turning off of said switching element for a predetermined time, are repeated as the polarity of the voltage applied to said liquid crystal is alternately reversed, so that an image is displayed, said apparatus comprising:

a designation means for specifying the contrast of an image to be displayed;

a correction means for changing the magnitude of the voltage applied to the liquid crystal of each display cell based on the contrast of said image specified by said designation means, and for correcting the magnitude of said changed voltage for each polarity by an amount also based on the contrast of said image specified by said designation means so that the absolute value of the voltage between said pair of transparent electrodes becomes equal when the switching element is turned off when said changed voltage is applied to a liquid crystal with a predetermined polarity and when said changed voltage is applied to a liquid crystal with a polarity opposite to said predetermined polarity.

* * * * *